US009099265B2

(12) United States Patent
Sotnikov

(10) Patent No.: US 9,099,265 B2
(45) Date of Patent: Aug. 4, 2015

(54) HIGH-VOLTAGE DISCONNECTION KNIFE FOR OUTDOOR USE WITH AIR INSULATION

(75) Inventor: Mikhail Sotnikov, Saint-Bruno (CA)

(73) Assignee: Mikhail Sotnikov (CA)

( * ) Notice: Subject to any disclaimer, the term of this patent is extended or adjusted under 35 U.S.C. 154(b) by 92 days.

(21) Appl. No.: 14/113,756

(22) PCT Filed: May 11, 2012

(86) PCT No.: PCT/CA2012/050311

§ 371 (c)(1),
(2), (4) Date: Oct. 24, 2013

(87) PCT Pub. No.: WO2012/151705

PCT Pub. Date: Nov. 15, 2012

(65) Prior Publication Data

US 2014/0048396 A1 Feb. 20, 2014

(30) Foreign Application Priority Data

May 11, 2011 (MX) ..... MX/a/2011/005004

(51) Int. Cl.

| | |
|---|---|
| ***H01H 31/00*** | (2006.01) |
| ***H01H 31/02*** | (2006.01) |
| ***H01H 1/42*** | (2006.01) |
| ***H01H 1/44*** | (2006.01) |
| ***H01H 31/16*** | (2006.01) |

(52) U.S. Cl.

CPC ..... *H01H 31/02* (2013.01); *H01H 1/42* (2013.01); *H01H 1/44* (2013.01); *H01H 31/16* (2013.01)

(58) Field of Classification Search

CPC ..... H01H 1/42; H01H 1/44; H01H 31/02; H01H 31/16

USPC ..... 200/48 KB

See application file for complete search history.

(56) References Cited

U.S. PATENT DOCUMENTS 3,230,324 A 1/1966 Johnson
3,676,623 A * 7/1972 Hollister et al. ..... 218/17

(Continued)

FOREIGN PATENT DOCUMENTS

EP 198506 A2 10/1986

OTHER PUBLICATIONS http://www.filnor.com/tech/literature/knifeswitch/Knife-Switch-Catalog-Full.pdf accessed on Aug. 1, 2012 (Jan. 8, 2012).

*Primary Examiner* — Kyung Lee
(74) *Attorney, Agent, or Firm* — Dilworth Paxson LLP

(57) ABSTRACT

A high-voltage disconnection knife insulated by air for external use in high-voltage electrical transmission and distribution networks, the disconnection knife includes two copper arms for the disconnection or contact, mounted in a parallel relation to each other, a front and rear contact base, a turning support in the vicinity of the rear base such that the arms turn at one of its ends about an axis perpendicular to them, a central copper block for distribution of the current flowing through the copper arms; the distance between the arms is defined by the set of stainless steel axes, the copper block and the turning mechanism. At the ends of the disconnection arms an aluminum spring of with transverse section of gradually reduced thickness is connected to the external surface, said spring being fixed to the ends of the arms by means of a pair of stainless steel axes. The front and rear L-shaped bases are formed by the bending of a copper sill with rounded edges to define an area of contact.

14 Claims, 9 Drawing Sheets

(56) References Cited

U.S. PATENT DOCUMENTS

| | | | | |
|---|---|---|---|---|
| 4,112,268 | A | 9/1978 | Chung | |
| 4,514,606 | A | 4/1985 | Veverka | |
| 5,293,012 | A * | 3/1994 | Levi | 200/48 P |
| 5,347,096 | A * | 9/1994 | Bolongeat-Mobleu et al. | 218/84 |
| 5,408,208 | A * | 4/1995 | DiMarco et al. | 335/14 |
| 5,889,248 | A * | 3/1999 | Plettner et al. | 218/7 |
| 7,091,431 | B1 * | 8/2006 | Arcand et al. | 200/48 R |
| 8,143,546 | B2 * | 3/2012 | De France | 200/554 |
| 8,476,546 | B2 * | 7/2013 | Abroy | 218/149 |
| 8,507,814 | B2 * | 8/2013 | De France et al. | 200/274 |

* cited by examiner

HIGH-VOLTAGE DISCONNECTION KNIFE FOR OUTDOOR USE WITH AIR INSULATION

FIELD OF THE INVENTION

The present invention refers to a high-voltage disconnection or circuit-breaker knife with air insulation, more specifically a high-voltage circuit breaker for outdoor use with air insulation, provided with two interchangeable bars located on a front base and another rear copper bar curved in L-shape with rounded edges, assembled by means of four transverse stainless steel axes which allow it to turn on the rear base.

BACKGROUND OF THE INVENTION

The prior art has many disconnection knifes in the form of a round or rectangular bar, where the contact surfaces in their entirety are planar, including between them the rounded curves, but planar at the end, and they do not have reference parameters with the contact pressure between the surfaces involved; being ineffective in the removal of oxides and general cleaning during the movement of connection and disconnection. There are parallel knifes with copper bar that exert a contact pressure on plane surfaces, said pressure being provided by means of springs mounted on the screw that joins the bars; but the circulation of current is allowed across this spring, and in doing so it becomes heated, with the consequent loss of tension upon changing its elastic limit, and then the contact pressure is lost with use, consequently generating micro-arcs and heating the bars until they melt.

One of the common recurring faults in the distribution substations is the sudden opening of the power breakers due primarily to overheating of the live parts of said breakers. This situation leads to the suspension of the electrical supply service, causing substantial losses to the users. The faults are due primarily to the generating of micro-arcs by wrong contact, which ultimately lead to the creation of a complete arc that melts the metal of the contact bar and interrupts the supply of electricity.

It is thus necessary to provide a device that is capable of maintaining the load levels, with operating capability above the current specifications, that can withstand greater loads without causing overheating and with a simple design that avoids the use of a large number of parts that are hard to assemble, in that special tools are required.

The disconnector of Japanese patent JP 2006351397, published on 28 Dec. 2006, whose inventor is Sasaki Toshiaki, describes a turning mechanism provided with a vertical actuator bar, coated with insulator; a horizontal bar is fixed onto the insulator and it can turn along with the vertical actuator bar; in turning, it connects or disconnects the electrical energy at the upper ends of the outermost insulators.

The disconnector system of Japanese patent JP 2005285534, published on 13 Oct. 2005, whose inventor is Uchida Yasushi, describes a plurality of monopolar disconnectors provided with a horizontal turn bar supported on a central insulator that causes the disconnection bar to turn, connecting or disconnecting the electrical energy at the upper ends of the insulators receiving and transmitting the energy, said insulators being fixed to a lower horizontal base. The central insulator is made to turn by means of an actuator bar.

Japanese patent JP 11120870, published on 30 Apr. 1999, whose inventor is Okamoto Tamotsu, describes a rotating disconnection knife with two contact ends that are coupled to two axial U-shaped fingers in horizontal position, said fingers being contained one inside the other. The knife is fixed to a rotating insulator and at the lateral ends it has contact surfaces in the form of a loop that enter into the flat surface finger of horizontal U-shape to close or open the circuit of electrical energy coming from the transformer.

Russian patent RU 2127006 published on 27 Feb. 1999, whose inventor is Konopel Kov et al., describes a disconnection switch provided with a frame together with one fixed insulator and another one that can turn; it also has a lever-type control mechanism. The current collector has two parallel contact knifes fastened by means of bushings, the ends of the knifes having springs that provide contact pressure.

Japanese patent JP 10079216 published on 24 Mar. 1998, whose inventor is Ito Hitoshi, describes a disconnection mechanism that consists of two fixed outside insulators and two middle insulators that can turn, provided with a knife section in the upper end, which are coupled together by means of the turning of the outermost insulators, thereby allowing or interrupting the flow of current through the outermost insulators.

The U.S. Pat. No. 4,112,268, published on 5 Sep. 1978, whose inventor is Chung Asunción, describes a disconnection knife that consists of a horizontal base on which are located two fixed outside insulators and one middle insulator which can turn, having at its upper end a knife or horizontal bar at whose ends it has a contact jaw that couples at each upper end of the fixed insulators, the coupling occurring at low pressure to enable an easy disconnection.

The U.S. Pat. No. 3,230,324 published on 18 Jan. 1966, whose inventor is Tomlinson F. Johnson, describes a quick disconnection switch for high voltage, in the switch two outside support insulators are connected by means of a base bar and in the body of same an interruption element in each of the insulators, of these disconnection elements one moves in the clockwise direction and the other counterclockwise to disconnect the flow of high-voltage current, the movement taking place by means of an intermediate mechanism between the ends of the disconnection elements.

The U.S. Pat. No. 3,004,117, published on 10 Oct. 1961, whose inventor is John W. Skooglund, describes a disconnection switch for high voltage provided with a base that has a pair of insulators at each end, at the upper edge of one pair of these is situated the fastening base for a disconnection bar that can turn in the vertical plane, on the insulator closest to the opposite pair is placed a mechanism for coupling, securing and releasing of the bar when it is in the horizontal connection position.

The U.S. Pat. No. 2,816,971, published on 17 Dec. 1957, whose inventor is Payton C. Mayo et al., describes a disconnection bar that turns on its base in the vertical plane to be coupled by gravity in the upper end of the insulator where the contact finger is located.

The British patent GB 718,343, published on 10 Nov. 1954, whose inventor is Joseph Daniel Hoffman et al., describes an arrangement of electrical contacts for disconnection switches with a tubular vertical knife that has a pressing mechanism provided by an internal spring against a contact roller on an inclined plane of a fixed flange that has a shoulder to prevent the deliberate disconnection of the vertical knife; in its middle section the knife has a contact element coated with silver to increase the conductivity; the device has mechanical means to adjust the knife relative to its contact surface and support.

The British patent GB 673,598, published on 11 Jun. 1952, describes a disconnection device for high-voltage circuits with a disconnection arm operated by an insulating lever that opens or closes the circuit to interrupt or allow the flow of current.

The British patent GB 643,953, published on 27 Sep. 1950, describes a disconnection switch for high voltage that provides protection against deterioration caused by the corrosiveness of the environment, such as the buildup of frost and dust and the corrosion caused by this; the mechanism comprises a knife with two degrees of freedom or double throw, making contact with high pressure, consisting of four insulators arranged in the shape of a cross, one at the supply post, the one fastening the knife at the center, and two connection ones at the opposite ends of the arms; the knife is disconnected from one of these when performing cleaning and repair work, while being connected at the opposite side; the base of the knife has a closed protection housing that protects it against frost or dust buildup from the surroundings; the knife turns in the vertical plane, making contact against planar surfaces.

Given the above, there is a need to provide a disconnection knife with safe and efficient performance that does not cause overheating on its live parts, while conducting the current across them, being made of electrolytic copper with low resistance.

SUMMARY OF THE INVENTION

One object of the present invention is to provide a high-voltage disconnection knife with air insulation for use outdoors, intended for external use at high and medium voltage electrical installations.

Another object of the present invention is to provide a high-voltage disconnection knife with air insulation for use outdoors, such that in the closed position the displacement contacts undergo an elastic deformation with pressure assisted by means of aluminum springs of partial cross section with gradual reduction.

Yet another object of the present invention is to provide a high-voltage disconnection knife with air insulation for use outdoors that has aluminum springs of partial reduced cross section without slots or with at least one central slot.

Still another object of the present invention is to provide a high-voltage disconnection knife with air insulation for use outdoors that has one or more contact fingers on each side of the knife, separated by a longitudinal end slot.

One object of the present invention is to provide a high-voltage disconnection knife with air insulation for use outdoors having a position of retraction of the rotation axis.

It is also an object of the present invention to provide a high-voltage disconnection knife with air insulation for use outdoors that has all its conduction elements fabricated in copper C110 ETPC or C182.

It is one object of the present invention to provide a high-voltage disconnection knife with air insulation for use outdoors that has interchangeable disconnection arms on both sides, provided with a scissors action for switching between the turning base and the contact fingers.

Yet another object of the present invention is to provide a high-voltage disconnection knife with air insulation for use outdoors that has a current distribution copper block that joins the internal surfaces of both arms.

Another object of the present invention is to provide a high-voltage disconnection knife with air insulation for use outdoors that releases the contact pressure of the knifes after the start of the opening maneuver.

One object of the present invention is to provide a high-voltage disconnection knife with air insulation for use outdoors that can be installed in any insulator without the need to disassemble any component.

Yet another object of the present invention is to provide a high-voltage disconnection knife with air insulation for use outdoors that has a reduction of contact pressure after turning by more than 30°.

It is also an object of the present invention to provide a high-voltage disconnection knife with air insulation for use outdoors that is adapted to mismatch of the contact bases.

Yet another object of the present invention is to provide a high-voltage disconnection knife with air insulation for use outdoors that improves the performance of the characteristics of knives of disconnection type.

DETAILED DESCRIPTION OF THE INVENTION

Figure 1:
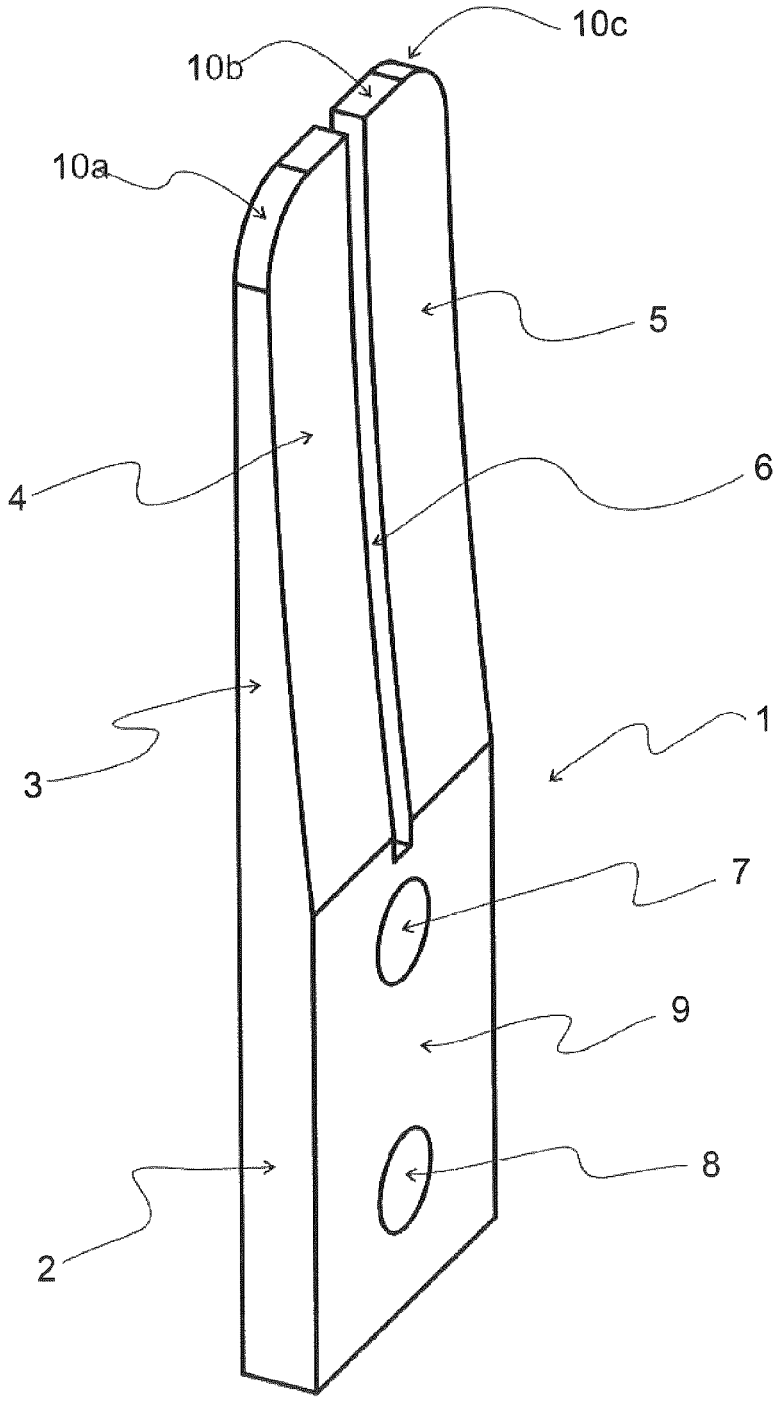
FIG. 1, is a perspective view of the external surface of the aluminum spring of gradually reduced cross section.

The present application specifies a disconnection knife for distribution and transmission networks that includes a new design of electrical contacts between rounded and planar sliding surfaces assisted by pressure exerted by attached spring, having a new design of the live parts for use outdoors with air insulation, manual operation for disconnection and connection; rated voltage in the range of 15 kV to 25.8 kV and with rated current values from 630 A to 2000 A with short circuit capabilities from a minimum of 40 kA to 50 kA; in addition to the mentioned characteristics, it has resistance values at the contacts of less than 20 micro-ohms. It is made of high-quality materials in combination with copper, aluminum, bronze, brass, stainless steel; it consists of two L-shaped copper bases, two feed blades or disconnection arms, one, two or four contact fingers separated by slots, a bronze fastening and turning mechanism, the perpendicular axes that fasten the arms being made of stainless steel. The L-shaped copper bases or plates are adapted to the existing insulators without the need for further changes, the edges of the short end function as contact surfaces and the long end forms the fastening base with the insulator.

The invention pertains to a disconnection switch (knife) with two straight contact blades or disconnection arms, in parallel, with rounded edges, for high voltage with air insulation for use in transmission and distribution networks. The switch includes two parallel copper connection or disconnection arms or blades with a central compensation block for the distribution of load that circulates through them, one front contact base, one rear contact base and, in the vicinity, a fastening and turning mechanism that enables the opening or closing of the knife for the operation of connection and disconnection, the turning taking place by means of a stainless steel axis located in a perpendicular position that joins the two component parts of the turning mechanism, made of brass or bronze, the parallel placement of the blades being assured by means of transverse axes in the section of the bases and an intermediate copper block for the compensation and distribution of current. At each end and at the external surface of the disconnection arms there is located an aluminum spring of reduced section, fastened by means of nut and threaded end of the transverse stainless steel axes that fasten to the joint formed by the copper arms and aluminum spring; the rounded edge is the contact area of the bases of the short section of same and the pressure is exerted on the flat surface of the arms, due to the difference in thickness and width of the bases with respect to the contact fingers in the arms, which compensate with the help of the spring associated with the end of each of them; the pressure does not cause the arms to lose their parallel position and just enough is exerted at the contact fingers and the rounded edge of the short section of the respective base.

The disconnection knife of the present invention is constructed with a minimum consumption of copper of electrolytic or chrome type C110ETPC or C182 that provides elements with low electrical resistance to avoid overheating; the turning system enables the releasing of pressure of the respective base due to an additional turning element, using multiple contact sections that along with an eccentric movement makes it possible to increase the contact pressure in a gradual way; the aluminum springs of reduced section are not part of the main structure, in order to equalize the pressure in all the contact fingers that are an integral part of the disconnection arms, provided with a joint that exerts pressure due to the elastic deformation that provides an additional pressure; the disconnection knife has a minimal electrical resistance or low resistance due to the construction of its elements with electrolytic copper or chrome copper and only consists of three main elements, the rear contact base, the front or contact base, and the disconnection arms or contact blades, which provides advantages in handling and construction due to its reduced number of parts.

The contact knifes are interchangeable, so that one can use the back side in the event that the front side is damaged; the copper pieces that conduct electricity have a dual function, a mechanical one and an elastic deformation one for the connection and disconnection; the mechanical rotation functions are provided by a stainless steel part or axis coupled to two parts of bronze or brass.

The disconnection knife of the present invention [is] used outdoors for the circuit breakers in electrical distribution and transmission networks; the circuit breaker includes two disconnection arms, mounted in a parallel relation to each other, a front base and a rear base with a turning mechanism that enables the connection or disconnection of the pair of arms via an axis transverse or perpendicular to them, said arms being assembled by means of four main transverse axes of stainless steel, located in pairs, two in the vicinity of each base, said axes defining the separation distance between the arms and their parallel relation, as well as the placement of the turning mechanism in a position centered with respect to the rear base; all the materials are resistant to corrosion, to prevent the degradation of the metals and other component materials.

Each of the ends of the disconnection arms has a connected spring which when assembled provides a disconnection knife actuated by spring; in this way, there is an elastic contact whose pressure is regulated by the connection of the end of the arm and the spring upon making contact with the rounded edge of each of the copper bases located at the ends, said bases being proportionately wider and thicker in relation to the arm; in the described layout, an elastic coupling is provided with pressure regulated by the spring and the end of the arm. The spring is a block of aluminum with gradually reduced transverse section, that is, a spring with curvature placed on edge and that provides an elastic coupling.

The disconnection arm or arms have a longitudinal slot or slots at the ends in order to define elastic fingers or zones of electrical contact; they divide the ends of the arms into a number of longitudinal sections or fingers of contact that coincide with the sections of the spring connected to the end of the conduction arm, this external connection being joined by stainless steel pins that define the separation distance and parallelism between the arms. When assembled, the ends of the conduction arms and spring form a series of contact fingers in an elastic assembly in cooperation with the bases, which is adapted to the action of an aluminum spring of reduced transverse section connected to the external surface of the end of the arm.

FIG. 1 shows a perspective view of the aluminum spring (1) which is placed on edge and has a gradually reduced transverse section (3) down to less than half of the thickness, with one or more axial slots (6) that run through all of the gradually reduced section and a second of constant thickness (2) with external and internal plane surface. The first section of constant thickness (2) defines a short plane face (9) provided with through openings (7 and 8), used to secure the spring via axes with threaded ends, where nuts are placed, which in turn secure the connections between the ends of some of the copper disconnection arms and the aluminum springs (1); the connection produces an elastic end section at the disconnection arm which, upon interacting with the rounded edge of a copper base with more thick and broad transverse section, produces a force of reaction that makes contact by pressure between the disconnection arm and the vertical section of the respective base. This base [has] rounded edges to allow the closing and opening of the disconnection arm in sliding fashion. The reduced transverse section (3) of the aluminum spring provides an elastic restoring force in its spring function, as well as functioning like a pair of springs owing to the central slot (6) which means the independent functioning at the two ends of the sections (4 and 5) of the aluminum spring of the present invention. The gradually reduced transverse section (3) defines an elastic element with a restoring force that does not lose its elasticity owing to the particular formation in which there are no forces that exceed the perfect elastic limit of the spring, neither are there temperature changes that cause a loss of elasticity of the spring. The base (9) of the spring provides the necessary support for the fastening to the disconnection arm via the through holes (7 and 8) which line up with the plane faces of the spring and the copper disconnection arm. The spring (1) that is placed on edge has one end of reduced thickness with rounded corners (10 and/or 10*c*) as well as a flat front edge (10*b*), which end is adapted to the shape of the copper disconnection arm, to which it is connected to enable the elastic response to the force exerted by the lateral edge of the contact base, which also has a central slot coinciding with the spring associated with it to form an elastic end that provides pressure upon contact.

Figure 2:
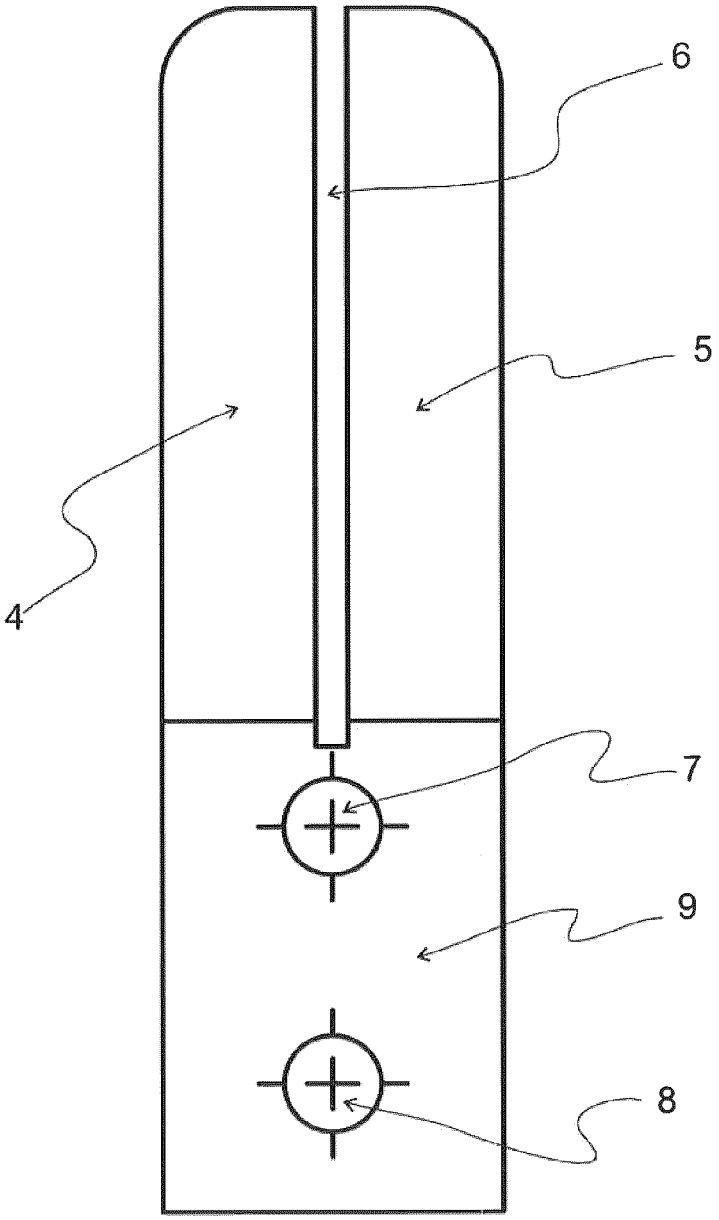
FIG. 2, is an upper plan view of the aluminum spring of reduced cross section.

FIG. 2 shows an upper view of the aluminum spring of reduced section, with the central slot (6) and the through openings (7 and 8) of the plane surface (9) accommodating the threaded ends of the transverse stainless steel axes for fastening to the disconnection arm. The longitudinal slot (6) provides the spring with two independent contact fingers (4 and 5) that exert pressure on the rounded edge of the vertical section of the base or short folded section that rises beyond the plane defined by the broader section for fastening to the insulator. The slot defines at least two contact fingers; but in another modality, it can have two or three slots, thereby defining three or four contact fingers, this depending on the width of the disconnection arm, which coincides with the width of the aluminum spring and the number of slots of each. Even the slot (6) need not be present, and there can be an aluminum spring with only a reduced transverse section that provides the elastic deformation needed to exert the contact pressure with the rounded edge of the base.

Figure 3:
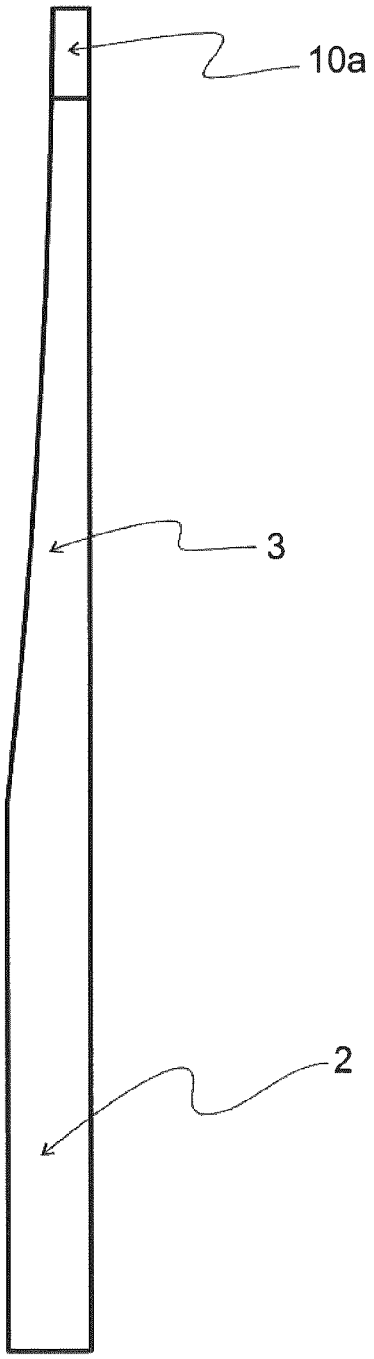
FIG. 3, is a side view of the aluminum spring of reduced cross section that provides the necessary elasticity to exert pressure.

FIG. 3 is a cross sectional view of the aluminum spring of gradually reduced transverse section, the section (2) having the same thickness, and it forms the section of plane surfaces for the fastening connection to the disconnection arm, the connection being achieved by matching up the plane section, not inclined, with the plane surface of the disconnection arm; the section of gradually reduced thickness (3) provides an elastic restoring force that allows elastic deformations at the end of the disconnection arm within the perfect elastic limit, that is, it does not permit the definitive deformation of the arm, in the final closure position it exerts a constant pressure on the rounded edge of the contact base; the section of the rounded end (10*a*) only defines the adequate shape for the matching to the shape of the end of the disconnection arm and also so that the corners do not strike the rear base in the opening turn.

Figure 4:
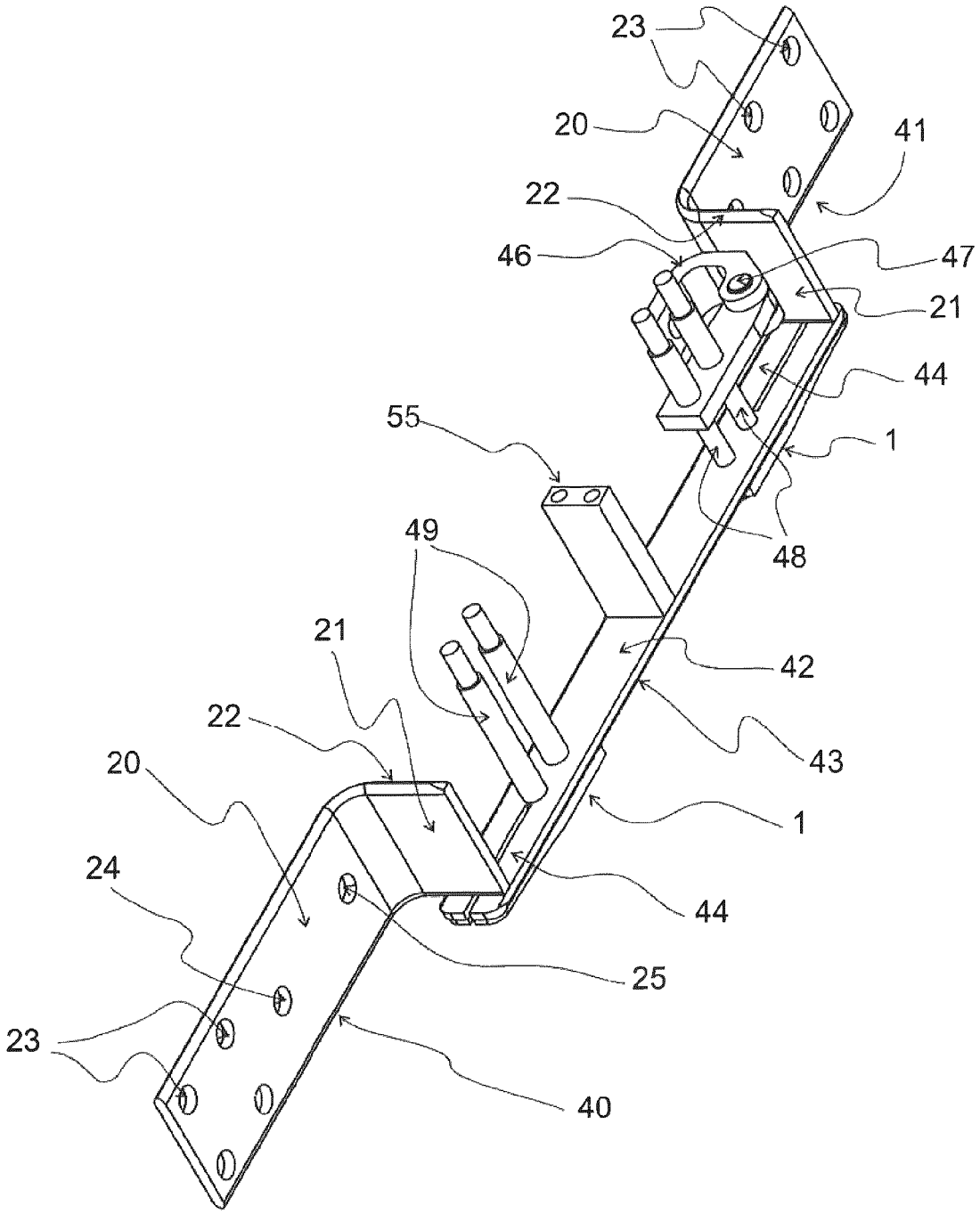
FIG. 4, is a perspective exploded view of the knife of the present invention, showing the bases, the turning mechanism, one conduction arm, the transverse axles that secure the two arms, the position of the aluminum springs and the current distribution block.

FIG. 4 shows an exploded perspective view of the disconnection knife of the present invention; it has a longer front base (40) and a short rear one (41) in the vicinity of the turning mechanism, a disconnection arm (42), a compensation block (55) for distribution of current, as well as the transverse stainless steel axes (48 and 49) that secure the disconnection or connection arms (42) and also a current conducting arm made of electrolytic copper; it also shows the location of the turning mechanism secured to the base of the corresponding insulator. The contact bases (40 and 41) are made of electrolytic copper, which provides a low resistance; they have an L-shape with the long flat surface provided with four through openings (23) lined up two by two, in which is connected the conductor for entry of the current and through which it exits in the respective bases; the longer base has two other openings (24) in the center line to fix the flat surface (20) or fastening section to the insulator base, the short contact section (21) is also flat but in a direction perpendicular to the adjacent surface (20), and it has its lateral edges (22) rounded to function as a surface of interaction with the contact fingers (44) integrated at each end of the disconnection arms (42), these fingers (44) can be single, forming a pair, in groups of three or more, the number depending on the number of slots possessed by each end of the disconnection arm; the edge of the upper corner of the short contact section (21) has an inclination that favors, on the one hand, the opening and closing (exit and entry) of the disconnection arm upon contact, and on the other hand the releasing of pressure at the start of the maneuver to open the circuit for a turn angle greater than 30° in cooperation with a mechanism provided with an asymmetrical axis of rotation (47); the turning mechanism is in the vicinity of the short base (41), it consists of a lower curved arm (46) in the shape of a hook, having in its base a through opening for fastening to the base of the insulator; at the other end of the hook it has a head with two separate seats to accommodate a straight sill provided with opening and rounded end with reduced transverse section to limit its turning, the opening of the sill is made to coincide with the openings in the seats of the head; in these openings is placed a short stainless steel axis (47) of slightly eccentric transverse section; the turning mechanism limits the turning of the disconnection arm to a maximum of 105°, then the disconnection arms (42) mounted in a parallel relation turn at one of their ends about the perpendicular axis (47); the straight sill is provided with two aligned openings, where are placed the axes (48) that secure the rear connection assembly of the springs (1) and the disconnection arms (42) and the turning mechanism. Halfway on the distance between the ends of the disconnection arms (42) there is a compensation block (55) of electrolytic copper, serving for the distribution of the current passing through the disconnection arms, in the unlikely event of a short circuit between the contact fingers and the contact edge of the bases, this block (55) being fixed to the internal plane surface of the disconnection arms (42) by means of a pair of screws at each end; the stainless steel axes (49) secure the other end of the disconnection arms (42) in the vicinity of the front base (40), along with the current distribution block (55) and the axes (48) they define the separation distance between the disconnection arms and maintain the parallelism of same at a minimum distance of 1.5 in (3.81 cm) making it possible to maintain high values of current density, such as 5 A/mm$^2$, without the creation of an electromagnetic attraction; the separation distance between the disconnection arms is defined by the width of the contact base with predetermined tolerances in order to have a close coupling between the edges (22) of the base and the internal surface of the contact fingers (44); in the external surface of both ends of the disconnection arms (42) there is fitted an aluminum spring (1) of gradually reduced transverse section that provides an elastic force to produce a contact pressure on the order of 2 kgf/mm to enable the conduction of a current strength of up to 500 A/mm; the disconnection knife of the present invention provides improved performance in the parameters of low resistance, good adaptability to misalignment, precise electrical parameters in regard to conduction (A/mm) and regulation of the contact pressure (kgf/mm), a high conductivity of the component materials, removal of the oxides formed on the conduction surfaces and possibility of repair in having disconnection arms with interchangeable surfaces, that is, if the contact surface is damaged in any way, the arms can be interchanged to make contact with the other surface. The contact pressure is achieved by the elastic deformation of the connection to the aluminum spring of gradually reduced section and the elastic deformation of the copper contact fingers. The turning mechanism made of bronze or brass with the rotation axis of stainless steel is aligned with the center of the rear base and has a mechanism which limits the displacement of the arm; in the closing maneuver there is a gradual increasing of the pressure on account of the eccentric movement of the rotation axis (47) and the end of the arms, where there are multiple sections separated by slots which define the contact fingers; there can be a single finger up to three fingers defined by two longitudinal slots, it depends on the width of the disconnection arm; a scissors type mechanism is provided to reduce the operating pressure in the opening or disconnection maneuver in the switching of the contact fingers and the base.

Figure 5:
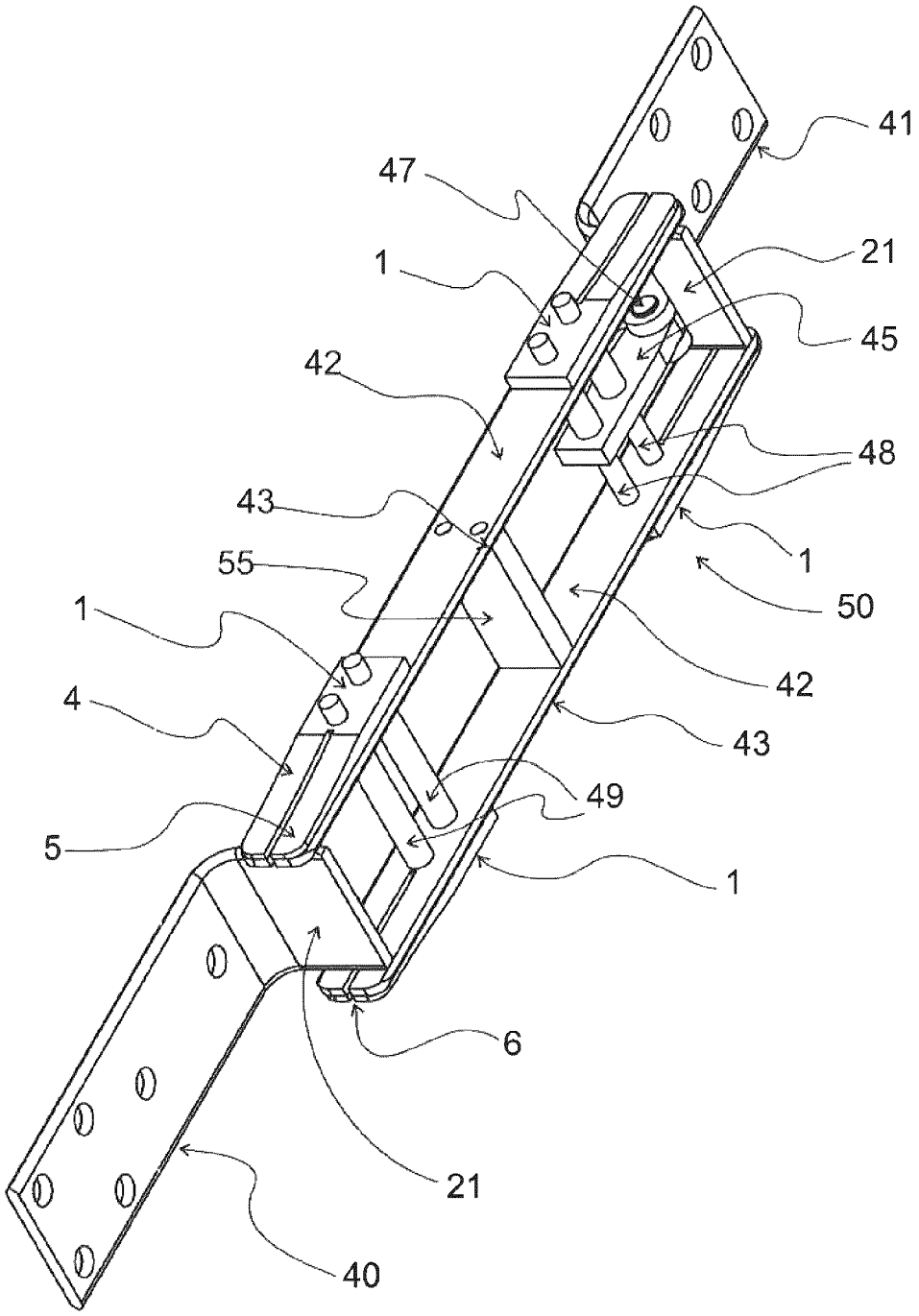
FIG. 5, is a perspective view of the knife of the present invention, showing the bases, the turning mechanism, the conduction arms, the transverse fastening axles of stainless steel, the position of the aluminum springs on the external surfaces of the ends and the current distribution block that joins the internal surfaces of the arms.

FIG. 5 is a perspective view that shows the disconnection knife (50) in its mounted position with two bases of electrolytic copper bent into an L-shape with the long section (40 and 41) for securing to the insulator and the short perpendicular section (21) to make contact with the two disconnection arms (42) at the ends of which each one has an aluminum spring (1) of gradually reduced transverse section with a central slot (6) that defines two fingers (4 and 5) coinciding with the contact fingers of the arms (42) which are held parallel thanks to the two pairs of stainless steel fastening axes (49 and 48) that secure the connection of spring (1) with arm (42) corresponding to the front base; the axes (48) in the rear base secure the connection of spring (1) with arm (42) and the central turning mechanism via the fastening sill (45) made of bronze or brass, said sill (45) of rectangular body with one pivot end with rounded edge and one flat inclined section that acts as an abutment to limit the turning to 115° for the complete opening of the knife or the disconnection arms, said turning being enabled by means of an eccentric rotation axis (47) of stainless steel, mounted on the head of a lower base in the form of a hook, anchored to the base of the insulator. The compensation block (55) for the distribution of current, made of electrolytic copper, also defines the separation between the disconnection arms (42), besides distributing the current and the heat produced in the event of a short circuit in any of the contact fingers defined by the slots (6) of the spring, coinciding with the slots of the arm, and defining the contact fingers with the edges of the sections (21) of the base; in regard to the event of a short circuit, as mentioned, it is possible for the contact surface of one arm to become damaged with thermal erosion, [but] each arm has a rounded longitudinal edge (43) making it possible to interchange the contact surfaces for the switching of the places of each arm, acting as a surface of approach with the edge of the contact base; said edge also facilitates the closing maneuvers, since it allows a soft assembly with the contact base in the closing operation and a releasing of pressure in the opening operation of the knife. The arms can turn 180° in the perpendicular direction and in the longitudinal direction to carry out the changing of the contact surfaces in a possible repair procedure. In the closing maneuver of the circuit or connection, the pressure increases gradually due to the eccentricity of the rotation axis (47) and the reduced transverse section of the connection defining the contact fingers.

Figure 6:
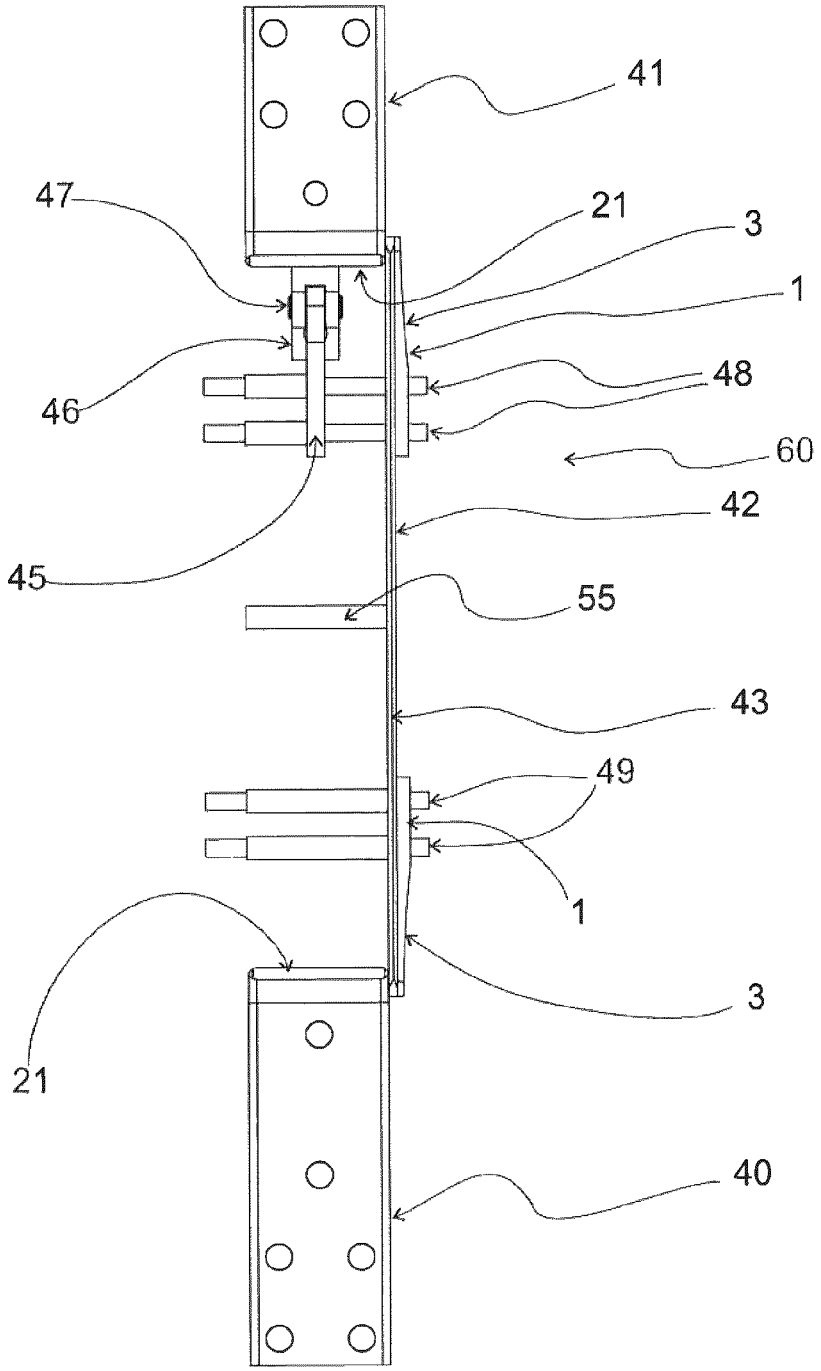
FIG. 6, is an upper exploded view of FIG. 4, showing the rounded edges of the disconnection arms and the bases, the fastening openings of same, and the arm/spring couplings.

FIG. 6 shows an upper exploded view of FIG. 4, showing in a plane view the front base (40) with the distribution of the four openings for the electrical connection and the two openings on the center line for the coupling to the base of the insulator, the base (40) with the perpendicular section (21) whose edges acts as rounded contacts over which slides the internal surface of the flat contact fingers of the ends of the disconnection arm (42) that cooperate with the edges of the contact bases to displace in elastic manner the ends of the arms along with the aluminum springs (1) of gradually reduced transverse section (3), the contact fingers are an integral part of the disconnection arms provided with rounded longitudinal edges (43) that act as a surface of approach with the rounded lateral edge of the contact base and that facilitate the interchanging of the arms; halfway down the length of the arms there is a compensation block (55) whose function is to diminish the overheating and to distribute current in the event of a short circuit produced in at least one of the contact fingers; the contact fingers, the compensation block (55), the stainless steel axes (49) rear the front base, [and] the stainless steel axes (48) near the rear base together secure and define the separation distance of the disconnection arms (42); the axes are also responsible for securing the connection of the arms (42) and the spring (1); in particular, the axes (48) secure to the turning mechanism formed by the lower hook-shaped base (46), the stainless steel rotation axis (47) and the upper fastening sill (45), the parts (46 and 45) are made of bronze or brass, the base (46) is secured to the corresponding insulator base, for this reason the rear base is shorter, in order to leave space for the base (46) of the turning mechanism, the disconnection arms have a dual purpose, the mechanical one of fastening and the elastic deformation which, in combination with the aluminum spring (1), generates the pressure with the edges of the contact bases.

Figure 7:
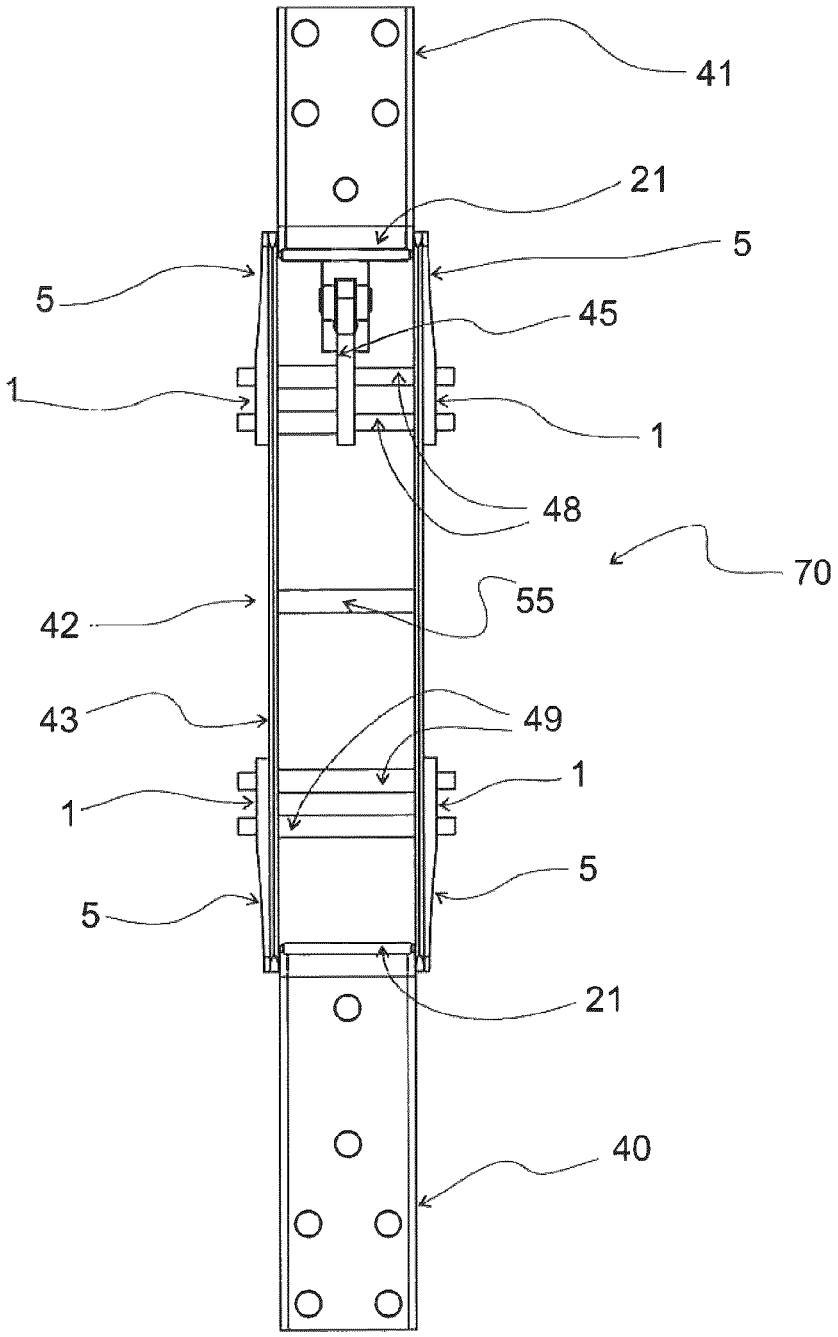
FIG. 7, is an upper view of the complete knife, corresponding to FIG. 5, in a closure position, showing the rounded edges of the disconnection arms and the bases, the fastening openings of same, the arm/spring couplings and the turning mechanism.

FIG. 7 is a top view (70) of the knife of FIG. 5, in total coupling of the parts with the disconnection arms (42), the compensation block (55), the contact bases (40 and 41), all these elements being made of electrolytic copper (C110ETPC or C182); the fastening axes (48 and 49) as well as the rotation axis are of stainless steel; the lateral aluminum springs (1) of gradually reduced section that provide the elastic deformation needed to provide the contact pressure with the respective bases; the turning mechanism (45) and its hook-shaped base, made of bronze or brass. In this drawing one only sees the upper section (5) of the aluminum spring (1) of reduced section; in regard to the disconnection arms, one notices the rounded longitudinal edge (43) that defines a surface of approach to the contact base. The contact bases are located on the bases of the existing insulators without the need for additional adaptations, such as their changing in order to use this type of knife.

Figure 8:
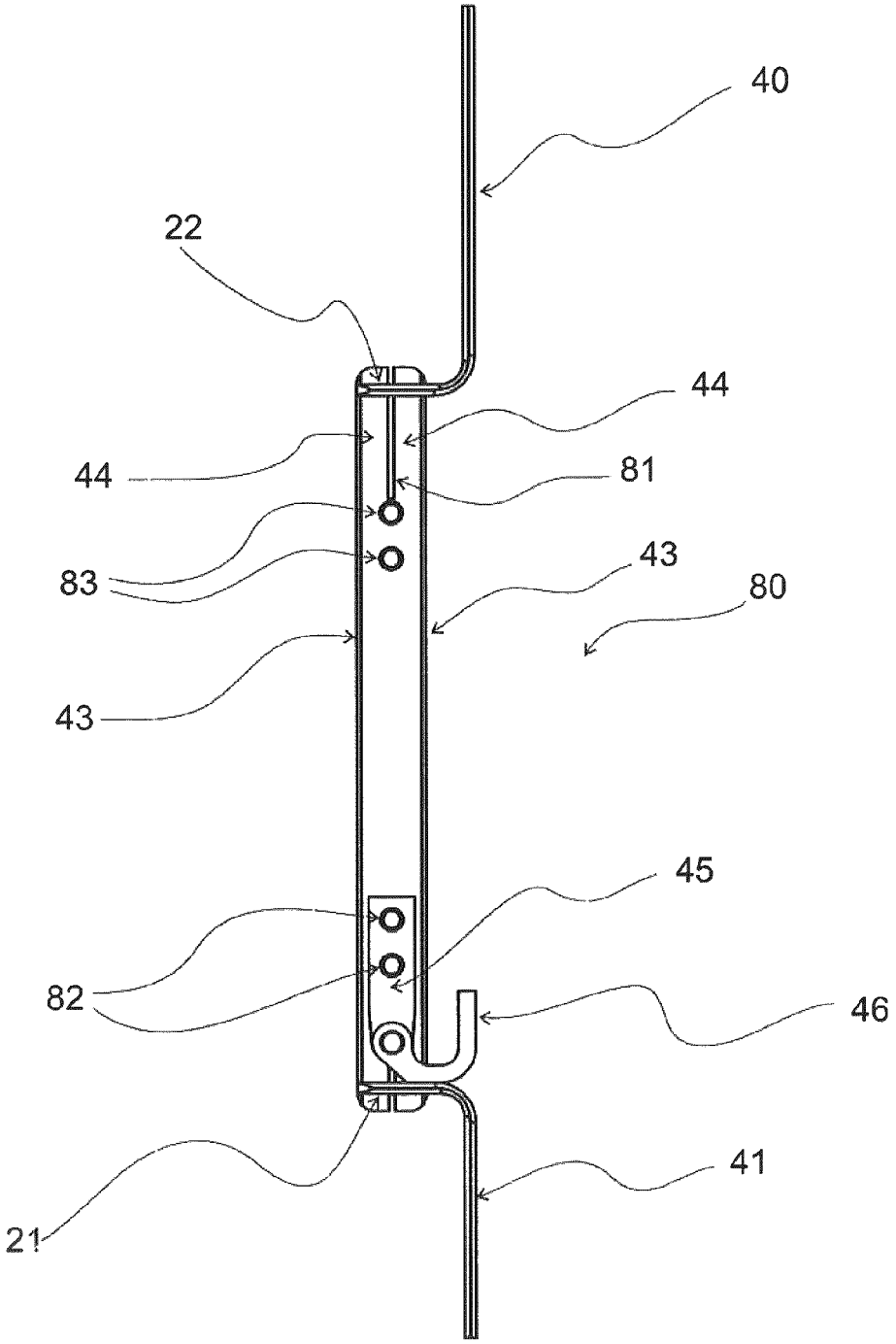
FIG. 8, is a lateral view of the internal surface of the exploded view, consisting of the front and rear bases in position corresponding to closure with one conduction arm and the turning mechanism.

FIG. 8 is a lateral view (80) of the internal surface of one of the disconnection arms in position with the contact base of the knife of the present invention, the front base (40) is lengthened and coupled in the guides along the entire length of the insulator base; on the other hand, the rear base (41) is short because it needs to compensate for the length of the fastening base (46) of the turning mechanism with the base of the insulator; then the contact base (41) is coupled in one section and the base (46) of the turning mechanism is fastened in the remaining section of the insulator; in this figure, one notices the rounded edge (22) of the perpendicular section (21) of the bases that interact with the contact fingers (44) defined by the longitudinal slot (81) of the disconnection arm, of which in turn one notices the rounded edge (43) of same as an approach surface, and the openings (82 and 83) provided for the stainless steel axes that secure the aforementioned connection and the turn mechanism by means of the upper sill (45), made of bronze or brass. In this figure, even though not given a reference number, it is possible to see the detail of the inclined plane of the upper corner of the section (21) of the contact bases, this plane serves as an approach surface between the arm and the base in the circuit closing operation, and also as a surface for releasing pressure in the circuit opening operation.

Figure 9:
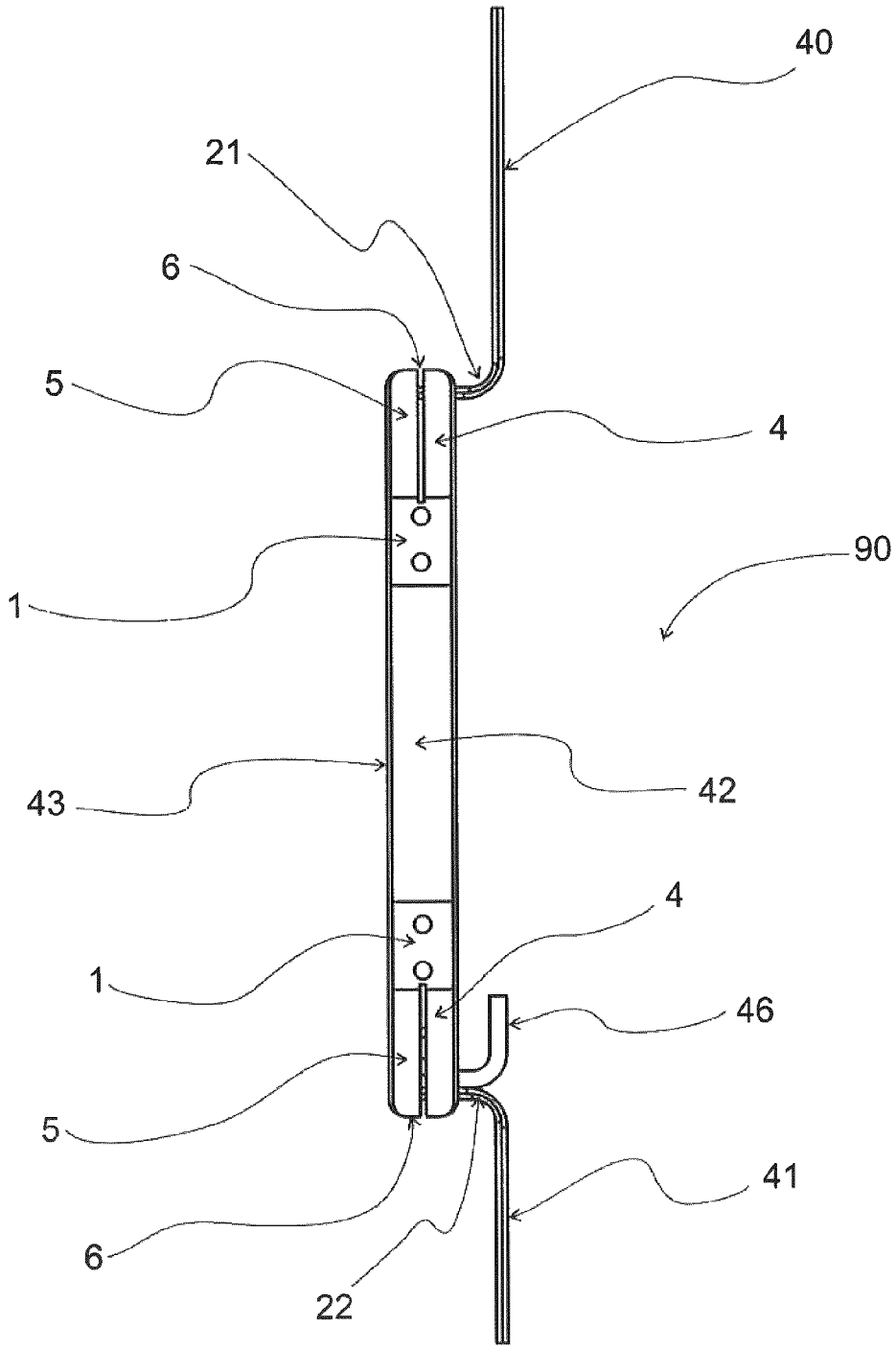
FIG. 9, is a lateral view of the external surface of the exploded view, consisting of the front and rear bases in position corresponding to closure with one conduction arm and the turning mechanism.

FIG. 9 is an external lateral view (90) with only one disconnection arm and the turning mechanism attached to it, the front base (40) is lengthened and couples in the guides of the entire length of the insulator base; on the other hand, the rear base (41) is short because it needs to allow the placement of the length of the fastening base (46) of the turning mechanism with the insulator base; then the contact base (41) is coupled to one section and the base (46) of the turning mechanism is secured in the remaining section of the insulator base; in this figure one notices the rounded edge (22) of the perpendicular section (21) of the bases that interact with the contact fingers defined by the longitudinal slot (6), which in this case show the sections (4 and 5) of the aluminum spring (1) of reduced transverse section lined up with the slot of the disconnection arm, of which there is seen the rounded edge (43) and its lengthened sill (42); the openings provided for the stainless steel axes that secure the aforementioned connection and the turning mechanism by means of the upper sill, supported on the base (46), secured to the insulator base, both elements being made of bronze or brass.

The invention claimed is:

1. A high-voltage disconnection knife for outdoor use with air insulation, the knife consisting of:

two L-shaped copper bases or flat plates with rounded edges, whose short section edge acts as a contact surface with the internal surface of the disconnection arms;

two copper disconnection arms that have slots dividing into a number of longitudinal sections the ends of the arms placed in a parallel arrangement, assembled by means of four main transverse axes of stainless steel that secure and define the distance between them;

a copper block for compensation of the additional and overheating current flow, located in the middle and on the internal surfaces of the disconnection arms;

an aluminum spring of gradually reduced transverse section located in parallel on the external surface of the end of each disconnection arm, fixed to same by means of a pair of transverse stainless steel axes;

a turning mechanism with a curved base of hook shape and a flat sill secured to a pair of transverse axes, it also includes a short axis of stainless steel that joins the base and the flat sill to form the turning mechanism, said axis functions as a rotation axis for the disconnection arms, the contact pressure between the ends of the arms and the base results from the elastic deformation of the assembly between the copper and the aluminum spring of gradually reduced transverse section at the ends of the disconnection arms.

2. The disconnection knife according to claim 1, further characterized in that all the conduction elements such as contact bases, disconnection arms and compensation block are made of electrolytic copper or chrome copper to provide a disconnection knife with low electrical resistance that prevents overheating.

3. The disconnection knife according to claim 1, further characterized in that the contact bases have an L-shape, the longer section is secured to the base of the insulator and the rounded edges of the short perpendicular section make contact with the internal surface of the longitudinal sections of the ends of the disconnection arms or contact fingers.

4. The disconnection knife according to claim 1, further characterized in that the ends of the connection arms have one, two or three slots dividing them into two, three or four longitudinal sections, respectively defining the contact fingers to provide one or more lines of contact with the edge of the bases.

5. The disconnection knife according to claim 1, further characterized in that at each end of the disconnection arms there is placed on edge an aluminum spring of gradually reduced transverse section, to form a connection that provides the contact pressure owing to the elastic deformation of the copper/aluminum connection.

6. The disconnection knife according to claim 1, further characterized in that the disconnection arms in closed position cooperate with the edges of the contact bases so that, when the contact fingers move, they experience an elastic deformation of the aluminum springs of reduced section and the ends of the disconnection arm.

7. The disconnection knife according to claim 1, further characterized in that the principal transverse axes of stainless steel are distributed in pairs, two in the vicinity of the front base and two in the vicinity of the rear base, which in turn secure the brass sill which can turn about a short axis perpendicular to the disconnection arms, it belongs to the turning mechanism.

8. The disconnection knife according to claim 1, further characterized in that the turning mechanism provides a scissors movement in the switching of the contact fingers and the base associated with the turning mechanism.

9. The disconnection knife according to claim 1, further characterized in that it has the same type of contact and pressure in both contact bases.

10. The disconnection knife according to claim 1, further characterized in that the turning mechanism limits the longitudinal displacement.

11. The disconnection knife according to claim 1, further characterized in that the maximum opening angle of the knife is 115°.

12. The disconnection knife according to claim 1, further characterized in that the minimum separation between the disconnection arms is 3.81 cm.

13. The disconnection knife according to claim 1, further characterized in that all the materials are corrosion-resistant to avoid degradation of the component metals.

14. The disconnection knife according to claim 1, further characterized in that the bases are designed to adapt to the base of existing insulators.

* * * * *